US011151968B1

(12) United States Patent
Lai

(10) Patent No.: US 11,151,968 B1
(45) Date of Patent: Oct. 19, 2021

(54) GUITAR NECK AND BODY JOINT

(71) Applicant: Christopher Lai, Paris (FR)

(72) Inventor: Christopher Lai, Paris (FR)

( * ) Notice: Subject to any disclaimer, the term of this patent is extended or adjusted under 35 U.S.C. 154(b) by 0 days.

(21) Appl. No.: 16/868,185

(22) Filed: May 6, 2020

(51) Int. Cl.

| | |
|---|---|
| ***G10D 3/06*** | (2020.01) |
| ***G10D 1/08*** | (2006.01) |
| ***G10D 3/04*** | (2020.01) |
| ***G10H 3/18*** | (2006.01) |
| ***G10D 3/22*** | (2020.01) |

(52) U.S. Cl.
CPC ..... *G10D 3/06* (2013.01); *G10D 1/085* (2013.01); *G10D 3/04* (2013.01); *G10D 3/22* (2020.02); *G10H 3/18* (2013.01); *G10H 2220/461* (2013.01)

(58) Field of Classification Search
CPC .. G10D 1/08; G10D 3/02; G10D 3/06; G10D 1/085; G10D 3/12; G10D 1/02; G10D 1/00; G10D 3/00; G10D 3/22; G10D 3/10; G10D 3/13; G10D 3/095; G10D 1/04; G10D 3/08; G10D 9/00; G10H 1/342; G10H 1/32; G10H 3/18; G10H 2220/301; G10H 2230/115
See application file for complete search history.

(56) References Cited

U.S. PATENT DOCUMENTS 1,788,745 A * 1/1931 Rowland ..... G10D 3/02 84/276
4,334,452 A * 6/1982 Morrison, III ..... G10D 1/085 84/267
4,359,924 A * 11/1982 Brunet ..... G10D 3/06 84/293
4,982,640 A * 1/1991 Buscarino ..... G10D 3/06 84/291
5,616,873 A * 4/1997 Fishman ..... G10D 3/04 84/293
6,005,173 A * 12/1999 Mitchell ..... G10D 1/00 84/291
6,051,766 A * 4/2000 Taylor ..... G10D 3/06 84/267
9,715,867 B1 * 7/2017 Schulte ..... G10D 3/12
9,852,718 B1 * 12/2017 Kelly ..... G10D 1/085
2007/0234877 A1 * 10/2007 Shaffer ..... G10G 1/02 84/464 A
2008/0092716 A1 * 4/2008 Breedlove ..... G10D 3/06 84/267
2008/0190263 A1 * 8/2008 Drew ..... G10D 3/02 84/291
2008/0190264 A1 * 8/2008 Jones ..... G10D 3/06 84/314 R
2014/0260889 A1 * 9/2014 Anderson ..... G10D 3/04 84/293
2015/0317959 A1 * 11/2015 Vogt ..... G10D 3/06 84/293

(Continued)

*Primary Examiner* — Marlon T Fletcher
(74) *Attorney, Agent, or Firm* — Kilpatrick Townsend & Stockton LLP

(57) ABSTRACT

A stringed instrument, for example an electric guitar, comprises a neck and a body defining a neck and body joint. The neck and body joint includes a neck having a tapered tenon, and a body having a complementary tapered mortise surrounding the tapered tenon. The tapered tenon may be held within the tapered mortise with a tensioning device without the use of adhesives between surfaces of the tapered tenon and surfaces of the tapered mortise.

20 Claims, 9 Drawing Sheets

(56) References Cited

U.S. PATENT DOCUMENTS

| | | | | |
|---|---|---|---|---|
| 2016/0027415 | A1* | 1/2016 | Hooker | G10D 3/06 84/293 |
| 2018/0218717 | A1* | 8/2018 | Varona | A61J 1/1406 |
| 2020/0265810 | A1* | 8/2020 | Planet Ylla | G10D 1/085 |

* cited by examiner

GUITAR NECK AND BODY JOINT

FIELD OF THE INVENTION

The present technology relates to stringed instrument assemblies and methods of manufacture thereof. Specifically, the technology relates to a neck and body joint of stringed instruments, particularly guitars, and more particularly electric guitars.

BACKGROUND

The neck and body of stringed instruments, particularly electric guitars, may be made of two distinct pieces that are coupled together with a joint. Existing electric guitar neck and body joints include bolt-on necks and set necks, also referred to as glued-on necks.

Bolt-on necks have the advantage of being able to be disassembled. However, this advantage of bolt-on necks is also a disadvantage in that when being assembled/reassembled the bolts may be secured either too loosely or too tightly, and/or may be secured in a misaligned manner so that the neck does not correctly align with the body. Bolt-on necks further have the advantage of providing sound clarity of notes played on the strings due to the wood on wood interface between the heel of the neck resting in a heel pocket in the body.

Set necks comprise the heel end of the neck being glued to the body. Set necks have the advantage of providing longer sustain compared to bolt-on necks due to a more rigid connection between the neck and the body. As used herein, the term "sustain" refers to a measure of musical sound over time. More particularly, sustain refers to the period of time that the sound of the guitar strings continues until the sound becomes inaudible. Set necks have the disadvantage of not being able to be disassembled in an easy manner, if at all. Particularly, in order to remove and replace or reattach the neck from the body the glued/adhesive bond is broken which may damage the body and/or neck. Additionally, attaching a new set neck or reattaching the previously installed set neck requires a trained technician and requires significant time in order to properly align the set neck and body and allow the glue/adhesive to set. Further, set necks have the disadvantage of muffled sound dynamics and lack of clarity due to the glue/adhesive between the neck and the body acting as a damper.

Further, bolt-on necks also have the disadvantage of a small contact patch between the neck and the body, which while being more clear and snappy than that of a set neck guitar, causes a lack of weight to the sound. For example, using bells as an analogy, a dinner bell and a church bell have different sound dynamics. A bolt-on neck causes a snappier, shriller, more immediate but ultimately thinner sound tending towards the dinner bell end of the scale whereas a set neck produces a sound that is more rolling, with a more rounded front-end and which lingers, i.e. has more sustain, and is more reminiscent of a church bell's dynamics.

An additional type of electric guitar is a neck-through construction wherein the neck extends to the tail end of the body and forms a portion of the body. Additional portions of the body, referred to as wings, are glued to the sides of the tail end of the neck to form the body. Neck-through construction has the disadvantages of being expensive to produce and not being able to be disassembled. Further, due to the glued on wings, neck through construction has similar disadvantages as glued-on necks relating to damping.

SUMMARY OF THE INVENTION

The present technology is directed toward a neck and body joint for a stringed instrument, particularly an electric guitar. The present technology includes a neck having a tapered tenon, and a body having a complementary tapered mortise surrounding the tapered tenon. The tapered tenon may be held within the tapered mortise with a tensioning device and without the use of glue/adhesives between surfaces of the tapered tenon and surfaces of the tapered mortise. The tapered tenon and tapered mortise neck and body joint of the present technology has the advantage of being able to be easily disassembled, having a large contact patch leading to good sustain, and having no adhesive/glue bonds coupling the neck to the body leading to clarity in the sound of the notes without the damping caused by glued joints.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Throughout this description for the purposes of explanation, numerous specific details are set forth in order to provide a thorough understanding of the many aspects and embodiments disclosed herein. It will be apparent, however, to one skilled in the art that the many aspects and embodiments may be practiced without some of these specific details. In other instances, known structures and devices are shown in diagram or schematic form to avoid obscuring the underlying principles of the described aspects and embodiments.

Figure 1A:
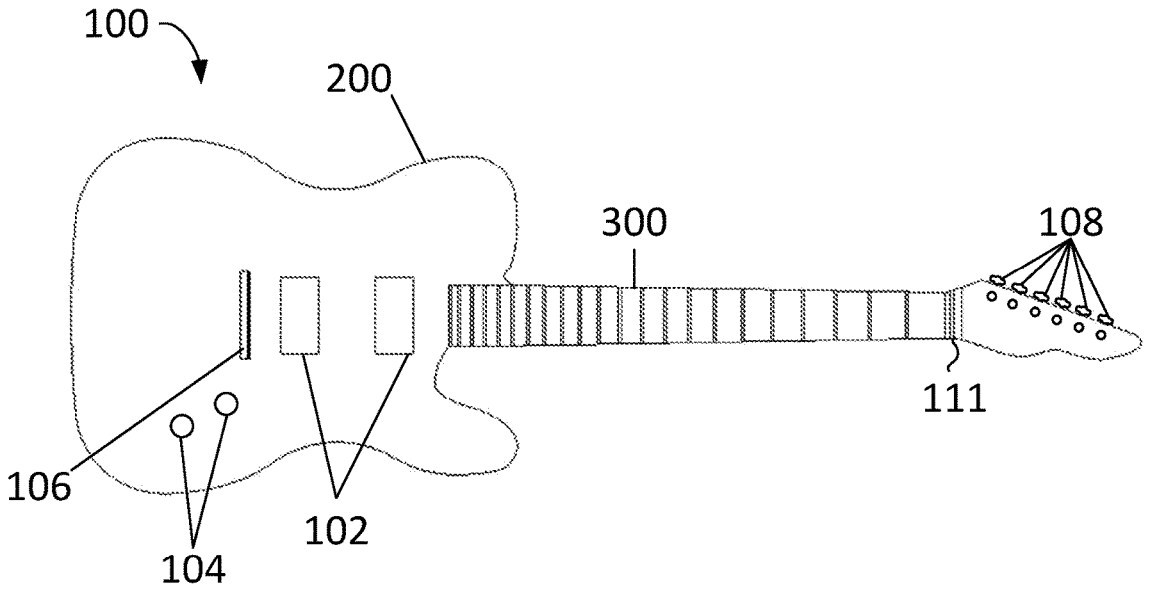
FIG. 1A shows a guitar according to embodiments of the present technology.

FIG. 1A shows a guitar assembly 100 according to the present technology. As shown, the guitar assembly 100 is comprised of a body 200, a neck assembly 300, and guitar hardware, for example pickups 102, control knobs 104 and internal circuitry, a bridge 106, tuning knobs 108, and strings (not shown for clarity). For clarity the guitar hardware is omitted in some of the figures herein, however embodiments of guitar assemblies and stringed instruments may include any combination of hardware.

Figure 1B:
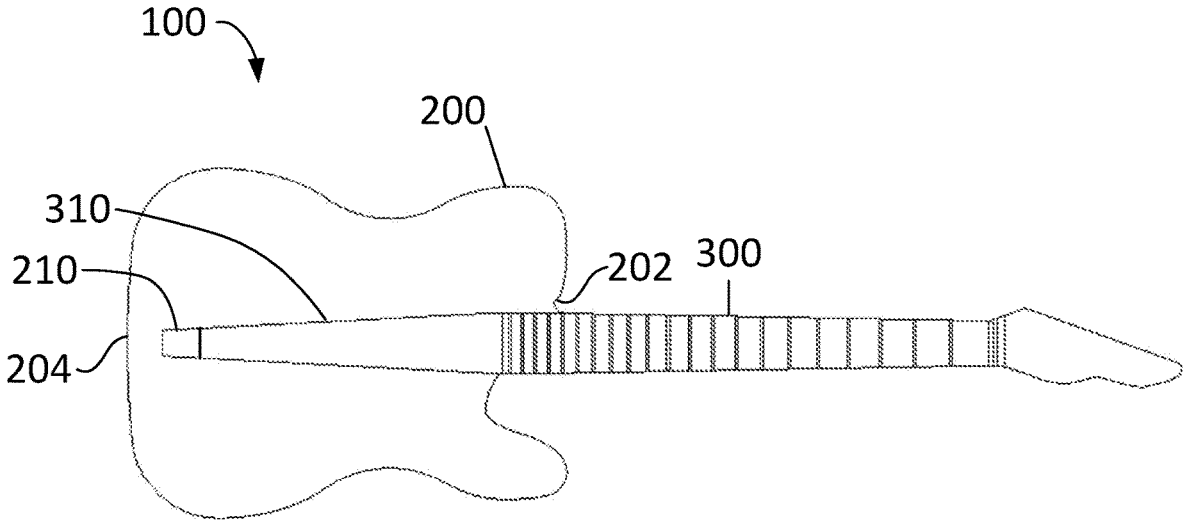
FIG. 1B shows a guitar according to the present technology with hardware and the top sheet omitted for clarity and to show a top view of the tapered mortise and tenon joint.
Figure 1C:
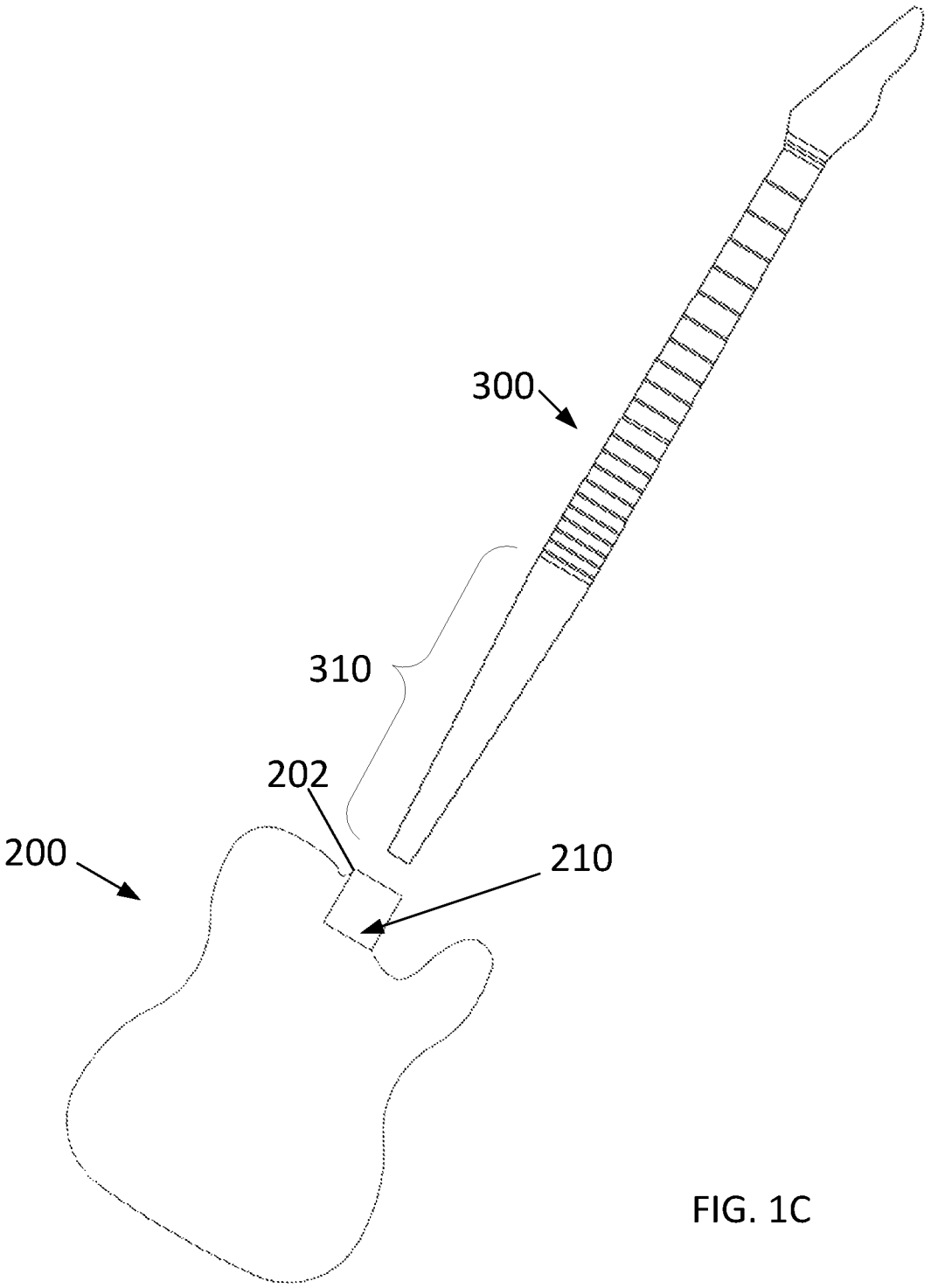
FIG. 1C shows a disassembled guitar comprising a body and a neck assembly according to the present technology.

FIG. 1B shows a top view of the guitar assembly 100 shown in FIG. 1A with the top sheet of the body 200 and the guitar hardware omitted in the figure for clarity purposes. FIG. 1C shows an exploded/unassembled view of the guitar assembly 100 of FIG. 1A with the guitar hardware omitted in the figures for clarity purposes. As shown in FIG. 1C the neck assembly 300 defines a tenon 310. In an assembled configuration the tenon 310 is received within a mortise 210 of the body 200, for example as shown in FIG. 1B. As shown in FIG. 1B relative to FIG. 1A the tenon 310 may extend from a neck end 202 of the body toward the tail end 204 of the body. The tenon 310 may extend into the body 200 to a position between the pickups 102 and the tail end 204 of the body, and may extend into the body to a position between the bridge 106 and the tail end 204 of the body, for example as shown in FIG. 1B.

As shown in FIGS. 1B and 1C, the mortise 210 and tenon 310 may each be tapered so that the ends of the mortise and the tenon closer to the tail end 204 of the body are narrower than the opposite end at the neck end 202 of the body. The body 200 includes interior surfaces defining the mortise 210 and the neck assembly 300 includes a tenon 310.

Figure 1D:
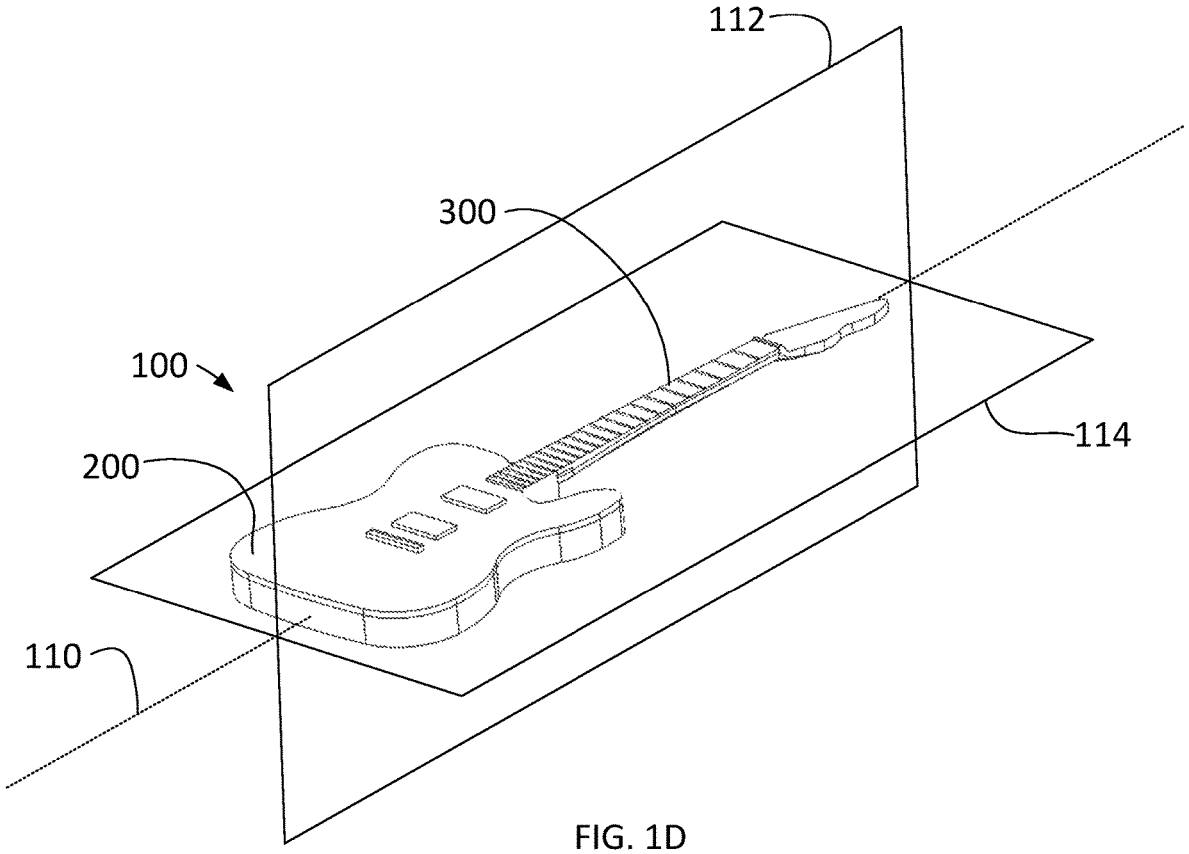
FIG. 1D shows a guitar according to the present technology with reference planes and a longitudinal axis defined relative to the guitar.

As used herein to refer to geometries and relative positions of the guitar assembly 100 a longitudinal axis and two reference planes are defined, as shown in FIG. 1D. The longitudinal axis 110 extends in a direction of the length of the body 200 and the length of the neck assembly 300, in a direction extending between the tail end 204 of the body and the headstock 302 of the neck assembly 300. A median plane 112 is defined coincident to the longitudinal axis 110 and perpendicular to top surface 206 of the body so that the median plane 112 divides the guitar into an upper portion (the portion which would be more proximate to the player's head during use) and a lower portion (the portion which would be more proximate to the player's feet during use). A frontal plane 114 is also defined, and as shown the frontal plane is coincident to the longitudinal axis 110 and is perpendicular to the median plane 112 so that the frontal plane is parallel to the top and bottom sides of the body.

Body

Figure 2A:
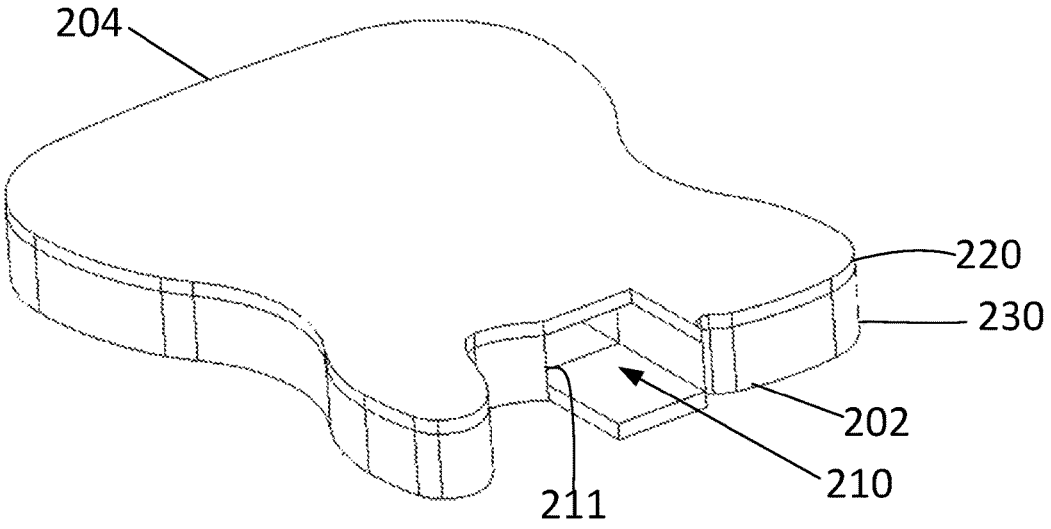
FIGS. 2A-2H show views of a body and portions thereof of a guitar according to embodiments of the present technology.
Figure 2B:
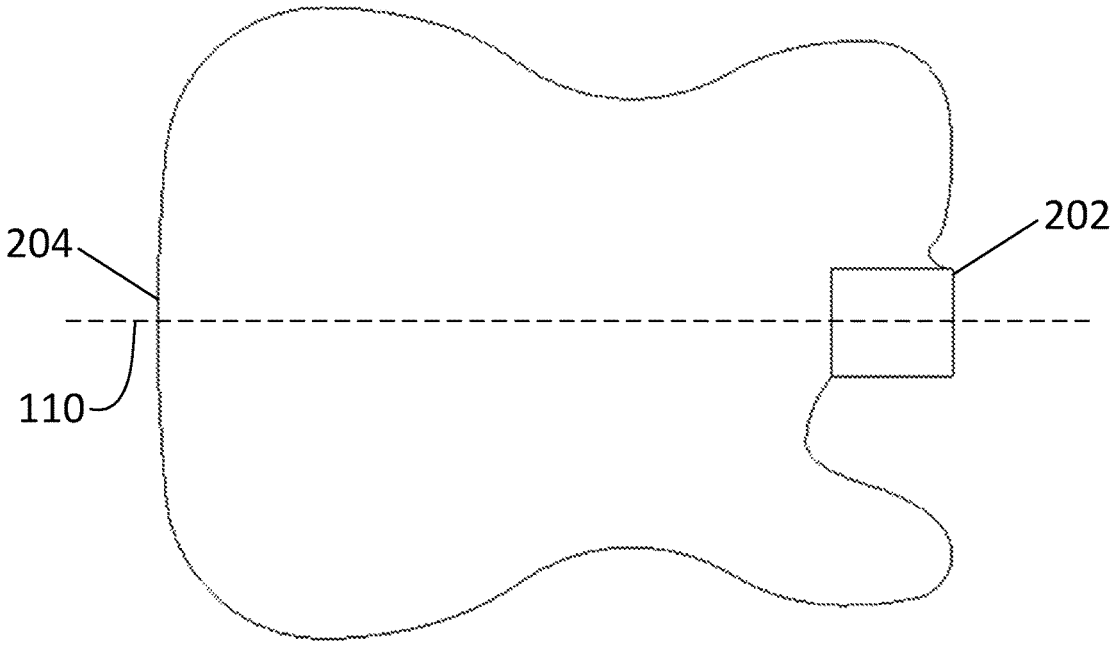

FIGS. 2A-2H show various views of the body 200 and portions thereof. In the embodiment shown, the body is that of a solid body type electric guitar. In embodiments, the body may be of any stringed instrument; may be of the solid body type or the semi-hollow body type; and may have zero, one or two cutaways. As shown in FIG. 2B, the body 200 extends along the longitudinal axis 110 and defines a length from the tail end 204 to the neck end 202. In embodiments, the body 200 may be of any size guitar or stringed instrument. The mortise 210 is open at the mortise opening 211 at the neck end 202 of the body 200, as shown in FIG. 2A. The mortise opening 211 may be on a plane perpendicular to the longitudinal axis 110. The mortise 210 extends from the mortise opening 211 at the neck end 202 of the body 200 toward the tail end 204 of the body 200. In embodiments the mortise may extend between 20% to 95% of the length of the body. A longer mortise, with a corresponding longer tenon between 75% to 100% of the length of the mortise, results in a longer and therefore larger contact patch for the mortise and tenon joint. It has been found that a mortise between 80% and 85% of the body produces an optimal balance of achieving good sound dynamic with a contact patch extending at least 75% the length of the body while also having a structurally sound body.

In embodiments, the body 200 comprises a top sheet 220, also referred to as a top body portion, and a bottom body portion 230. The top body portion 220 and the bottom body portion 230 may each be formed from a single piece of wood, or may each be formed from one or more pieces of wood. For example, in embodiments, the body is comprised of a single piece top sheet, and a two piece bottom body portion, wherein the two piece bottom body portion is comprised of a bottom sheet and a middle sheet so that the middle sheet is sandwiched between the top sheet and the bottom sheet. In embodiments, it is beneficial for the body portions to each be formed from a single piece of wood in order to reduce or eliminate damping causes by glue/adhesive coupling the pieces of wood together.

Figure 2C:
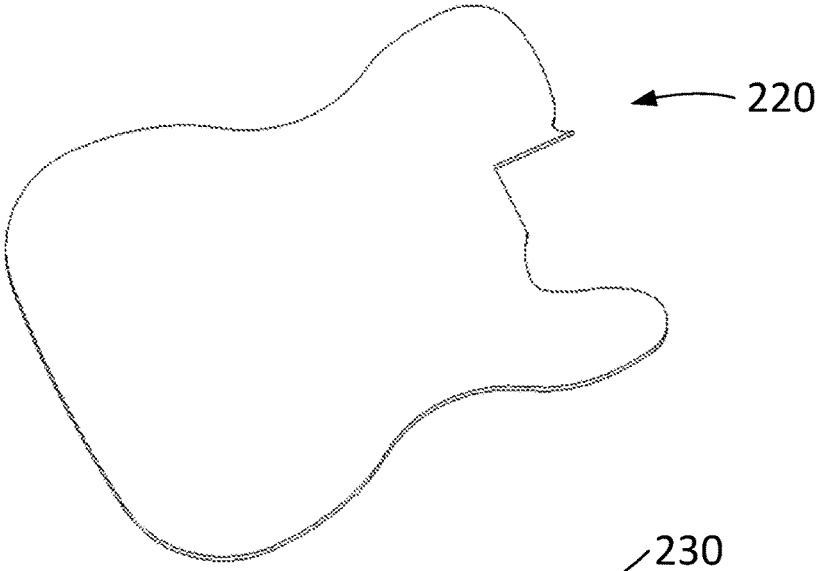
Figure 2D:
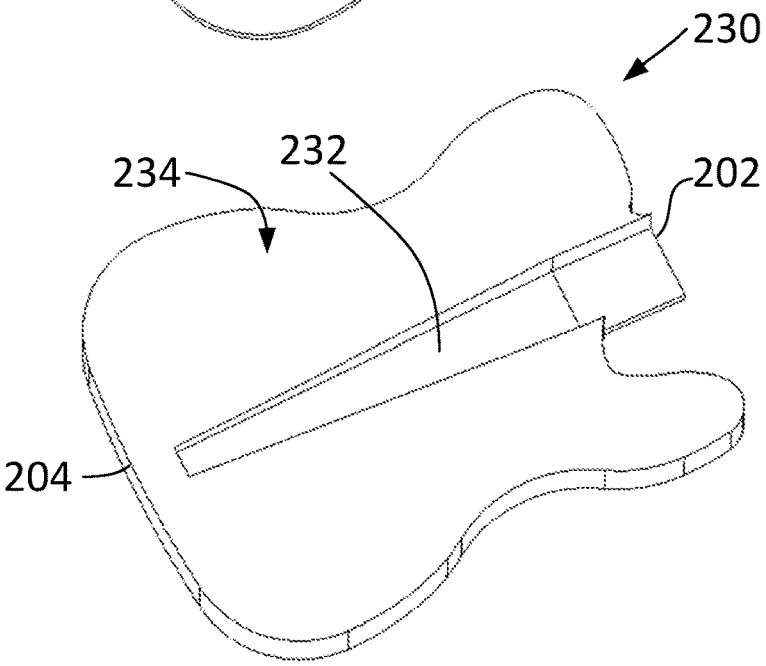
Figure 2E:
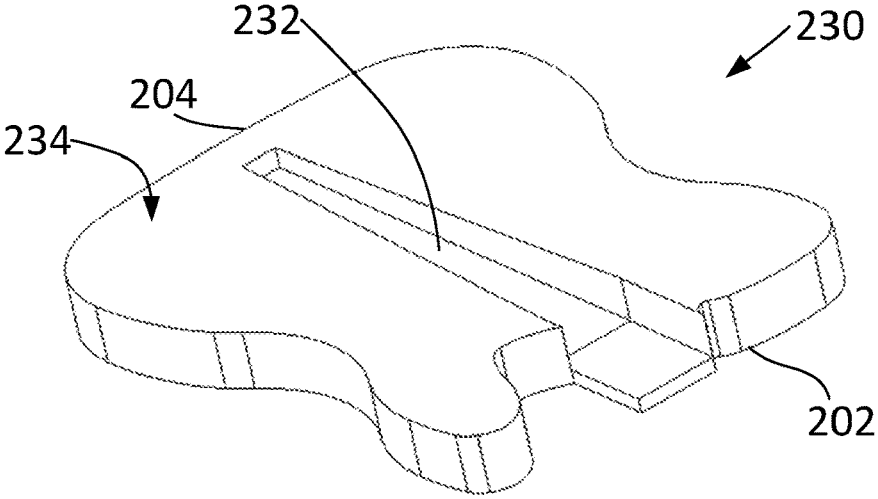

FIG. 2C shows an embodiment of a top body portion 220 formed from a single piece of wood, and FIGS. 2D and 2E show an embodiment of a bottom body portion 230 formed of a single piece of wood. This configuration is beneficial in that it leads to simplified manufacturing of the mortise while also benefiting from a large continuous wood volume leading to the desirable musical instrument quality.

The top body portion 220 may define a substantially planer bottom surface complementary to the top surface 234 of the bottom body portion. The top body portion may have the same body outline as the bottom body portion. The top and bottom body portions are coupled together to define the mortise between the top and bottom body portions. The top and bottom body portions may be coupled together by one or more of the following methods: adhesive, mechanical fasteners (e.g. screws), and wood joinery.

As shown in FIGS. 2D and 2E, in embodiments the bottom body portion 230 defines a mortise trench 232 extending in a direction parallel to the longitudinal axis 110 from the neck end 202 of the bottom body portion toward the tail end 204 of the bottom body portion. As shown in FIGS. 2D and 2E the mortise trench 332 is open at the neck end 202 and the top surface 234 of the bottom body portion 230.

The mortise in the body is defined by inwardly facing surfaces around the longitudinal axis, and a mortise end surface at the tail end of the mortise. In embodiments, the mortise is defined by four inwardly facing surfaces around the longitudinal axis including a bottom mortise surface 252, a top mortise surface 250, and two opposing side mortise surfaces 251. Each of the inwardly facing surfaces defining the mortise may be planar.

Figure 2G:
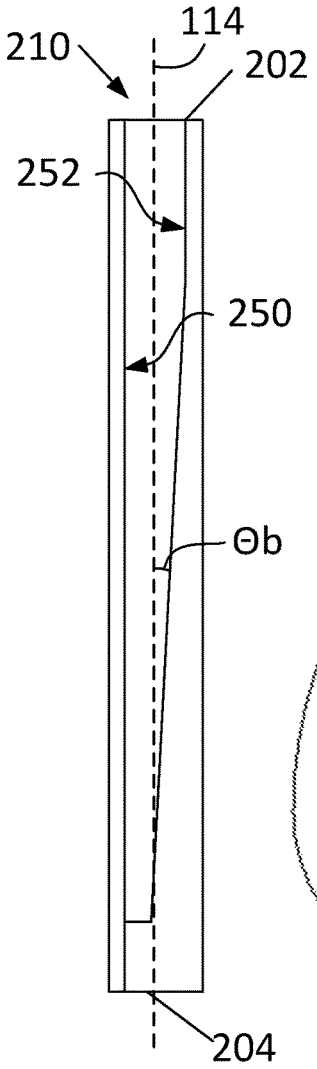
Figure 2F:
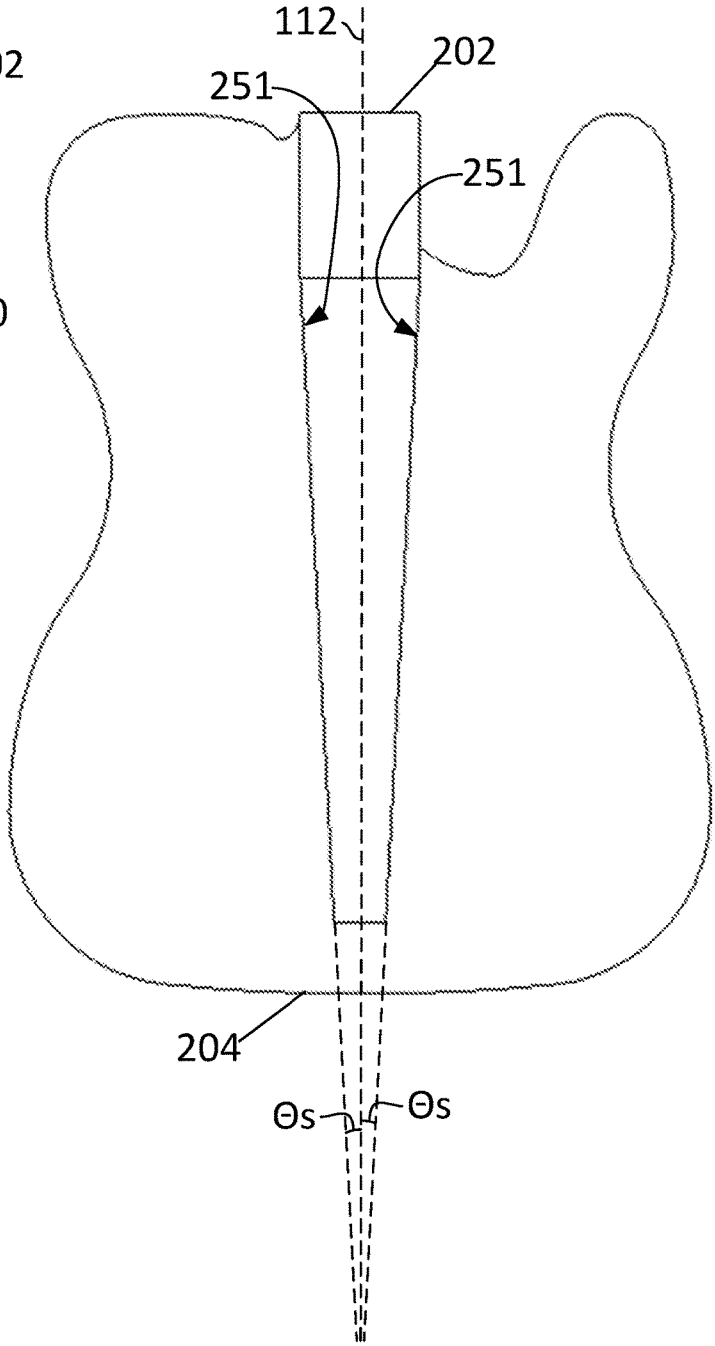

As shown in FIG. 2F, the side mortise surfaces 251 may be on opposite sides of the median plane 112 and face each other. As shown in FIG. 2F, in this view the median plane is coincident to the longitudinal axis. Further, the side mortise surfaces 251 may not be parallel to each other and may taper towards each other so that the distance between the side mortise surfaces is greater towards the neck end 202 of the mortise than at the tail end 204 of the mortise. As shown in FIG. 2G, the bottom mortise surface 252 may be angled relative to the frontal plane 114 so that the distance between the top surface 206 of the body and the bottom mortise surface 252 is greater at the neck end of the mortise than at the tail end of the mortise. As shown in FIG. 2G, in this view the frontal plane is coincident to the longitudinal axis.

Figure 2H:
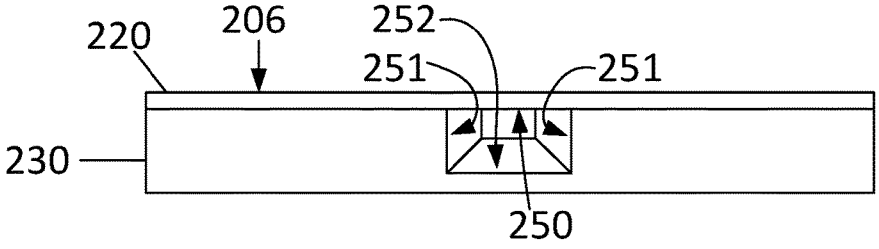

A portion of the bottom surface of the top body portion 220 may define the top mortise surface 250 of the mortise, as shown in FIGS. 2G and 2H. In embodiments, the top mortise surface 250 is parallel to the frontal plane 114. In the embodiment shown in FIGS. 2A-2H, the mortise 210 includes surfaces that taper relative to both the frontal plane 114 and the median plane 112.

The mortise 210, for example as shown in FIG. 2H, may have four sides around the longitudinal axis 110, wherein three of the sides are tapered relative to at least one of the frontal plane 114 and the median plane 112 and one side it not tapered relative to either the frontal plane or median plane. With this configuration, the mortise cross-section perpendicular to the longitudinal axis 110 is rectangular, for example as shown in FIG. 2H. In embodiments, for a tapered mortise the mortise cross-section at the neck end of the mortise is larger than the mortise cross-section at the tail end of the mortise, for example as shown in 2H. For example, the mortise cross-section at the neck end of the mortise has a width of 55 mm and tapers along a 270 mm length to 45 mm at the tail end.

In embodiments, for example as shown in FIG. 2F, angles "Θs" are defined between the side mortise surfaces 251 relative to the median plane 112, and may be between 0 and 15 degrees, and preferably between 0.05 and 5 degrees. The angle may be selected so that the tenon has a length of at least 50% of the length of the body. The angles Θs for each side mortise surface 251 may be equal to each other. The angles Θs of the side mortise surfaces 251 being equal to each other has the advantage of providing equal lateral normal force between the side mortise surface 251 and the side tenon surfaces 351 of the tenon 310. Angle "Θb", for example as shown in FIG. 2G, is defined between the bottom mortise surface 252 relative to the frontal plane 114, and may range between 0 and 15 degrees, and preferably between 0.05 and 5 degrees. In embodiments, the angles Θs and Θb may be equal. In embodiments, the side mortise surfaces in addition to being angled relative to the median plane may also be angled relative to a plane that is perpendicular to the frontal plane and not parallel to the median plane so that for any cross-section perpendicular to the longitudinal axis the cross-section is wider at the top of the mortise trench than the bottom. As shown in FIGS. 2G and 2H the top body portion 220, which may also be referred to as a cap, may be about 10% of the total thickness of the body 200. Further, in embodiments the top body portion 220 may range from 10% to 90% of the total thickness of the body. In embodiments, the side mortise surfaces 251 may be defined by portions of top body portion 220 and/or portions of the bottom body portion 230. For example, the top body portion 220 and the bottom body portion 230 may both define the mortise trenches, so that when the top and bottom body portions are coupled together the two mortise trenches are aligned and cooperate so that each of the two side mortise surfaces are defined by both the top and bottom body portion.

As noted, the mortise along the longitudinal axis may define a rectangular cross-section defined by four inwardly facing surfaces of the body around the longitudinal axis. In embodiments, the cross-sections perpendicular to the longitudinal axis may be triangular, square, pentagonal, hexagonal, or other polygons. The sides of the cross-section of the mortise may be any combination of straight and/or curved sides. In embodiments, as least one of the surfaces of the mortise around the longitudinal axis is tapered relative to at least one of the frontal or median planes so that the cross-section of the mortise decreases in area from the neck end of the mortise toward the tail end of the mortise. The tapering of the mortise creates a normal force on the corresponding surfaces of the mortise and tenon joint in response to the tenon of the neck assembly being tensioned toward the tail end of the body.

In embodiments, the body may be formed by milling the bottom body portion to have the outline shape of the body and milling the bottom body portion to form the mortise trench. The milling of any of the body portions may be performed in any order. In embodiments, the bottom body portion may be milled to have other cavities, for example for acoustic purposes, and/or for housing electronic components (e.g. pickups, circuit boards, pots, cable jacks, wiring), and/or other hardware, for example, bridge assemblies, tailpieces, tremolo assemblies. After the mortise trench of the bottom body portion is formed the top body portion may then be coupled, for example with adhesive or mechanical fasteners (e.g. screws) to the bottom body portion.

In embodiments, the body, or the portion of the body defining each side of the mortise, may be formed from one piece of wood so that the sides of the mortise, for example as described in embodiments herein, are monolithic.

Neck Assembly

Figure 3A:
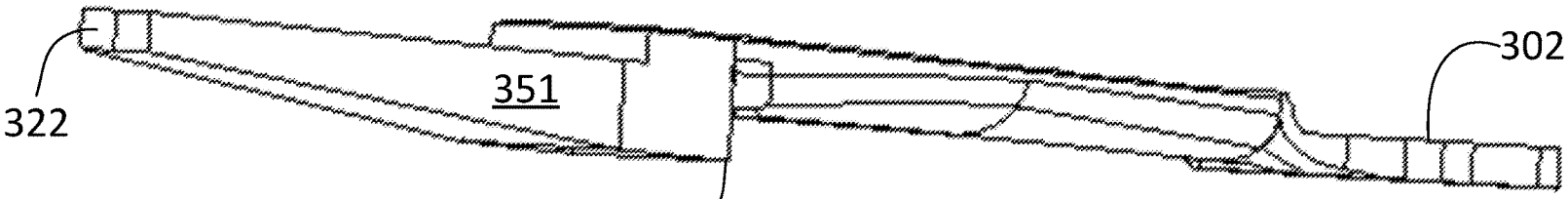
FIGS. 3A-D show views of a neck assembly according to embodiments of the present technology.
Figure 3B:
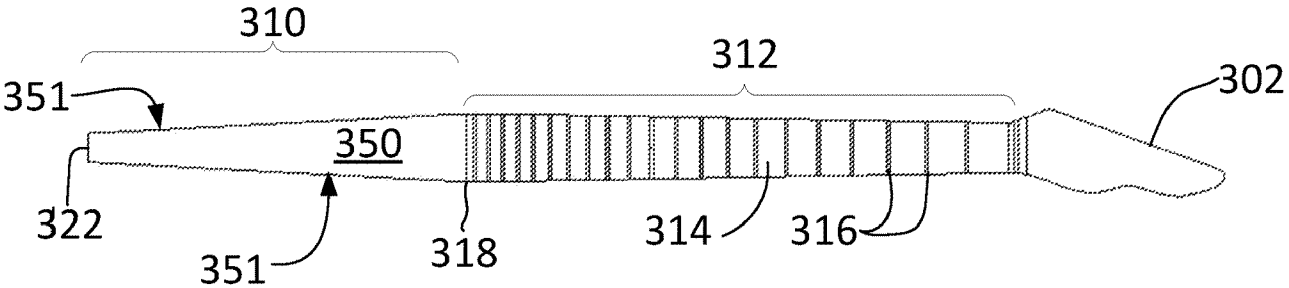
Figure 3C:
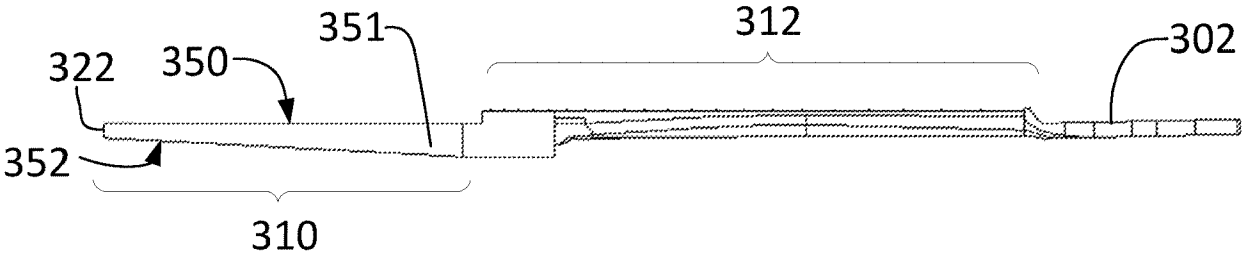
Figure 3D:
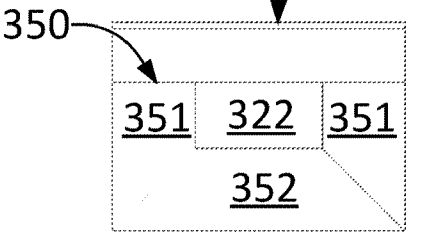

In addition to the tenon 310, the neck assembly 300 may further comprise a headstock 302, for example as shown in FIGS. 3A-3C. Embodiments may include any shape headstock. The neck assembly 300 further includes a central neck portion 312 between the headstock 302 and the tenon 310. The neck assembly further includes a fingerboard 314 that may include frets 316 along the scale of the neck, for clarity only a portion of the frets are annotated in the figures. In embodiments, at least portions of the central neck portion and tenon are formed from the same piece of wood. For example as shown in FIGS. 3A-3C, the headstock 302, central neck portion 312, and tenon 310 are monolithic and formed from a single piece of wood. In embodiments, the central neck portion and the fingerboard may be formed from the same piece of wood or may be formed from different pieces of wood. In embodiments, the headstock and/or fingerboard may also be formed from the same piece of wood as the central neck portion and the tenon. As shown in FIG. 3C, the central neck portion 312 and the tenon 310 meet at a neck heel 318. The tenon 310 extends from the neck heel 318 to a tenon tail end surface 322. The central neck portion, the fretboard, and/or the headstock may comprise frets, tuners, a nut, and a truss rod. In embodiments, the central neck portion may define a cavity housing a truss rod. The truss rod may extend from the headstock end of the central neck portion. In embodiments, the truss rod may extend to any position between the neck end of the tenon and the tail end of the tenon. The tenon of the neck assembly is complementary in shape to the mortise of the body. In the embodiment shown in FIGS. 3A-3D, the tenon defines a top tenon side 350, two side tenon sides 351, and a bottom tenon side 352. The angles of the side tenon sides match the angles of the mortise side surfaces, and the angle of the bottom tenon surface matches the angle of the bottom mortise surface. The top tenon surface is parallel to the frontal plane to be complementary to the top mortise surface.

In the assembled state the complementary surfaces of the mortise 210 and the tenon 310 are in direct wood to wood contact, with no glue/adhesive interface, thus forming a large glue-less contact patch. This glue-less contact patch reduces or eliminates damping of sound caused by glue/adhesive interfaces between wood surfaces. The cross-section of the tenon 310 at the neck heel 318 matches the cross-section of the mortise opening 211 so that the neck end of the tenon 310 is flush with the body 200 and the central neck portion 312 is flush with the body 200 and extends away from the neck end 202 of the body 200.

In embodiments, the width of the opening of the mortise and the neck end of the tenon may be narrower, the same width, or wider than the width of the central neck portion and/or fingerboard at the neck heel.

The depth/thickness of the opening of the mortise and the heel end of the tenon may be between 40% and 90% of the total thickness of the body. In embodiments, the thickest portion of the tenon is between 75% and 80% of the thickness of the body which results in an optimal balance of the size of the contact patch of the mortise and tenon joint while providing a sufficient structure of the body on the top and bottom sides of the mortise and tenon joint.

In embodiments, the tenon may range from 80% to 100% of the length of the mortise. In embodiments, in the assembled state the tail end surface 322 of the tenon 310 may be located at any position between a first position about halfway between the mortise opening 211 and the bridge 106 and a second position between the bridge and the tail end of the body so that the length of the neck assembly from the nut 111 to the tail end surface 322 of the tenon is longer than the scale length of the instrument, which is defined between the nut and the bridge.

The interface between the mortise surfaces and the tenon surfaces restrains five of the six degrees of freedom. Specifically the mortise and tenon joint by itself restricts relative motion comprising: 1) roll (around the longitudinal axis), 2) pitch (rotation at an angle relative to the frontal plane), 3) yaw (rotation at an angle relative to the median plane), 4) translation in a direction in the median plane and orthogonal to the longitudinal axis, and 5) translation in a direction in the frontal plane and orthogonal to the longitudinal axis.

The mortise tenon joint further limits 6) translation of the neck toward the body in the longitudinal direction due to the normal force caused by the interface of the surface angles relative to the frontal and median planes. The only degree of motion not directly restrained by the mortise and tenon joint is translation of the neck away from the body, i.e. moving the neck assembly out of the mortise in the body. In embodiments, a tensioning device is used to restrain the neck assembly from being pulled out of the mortise.

Figure 4A:
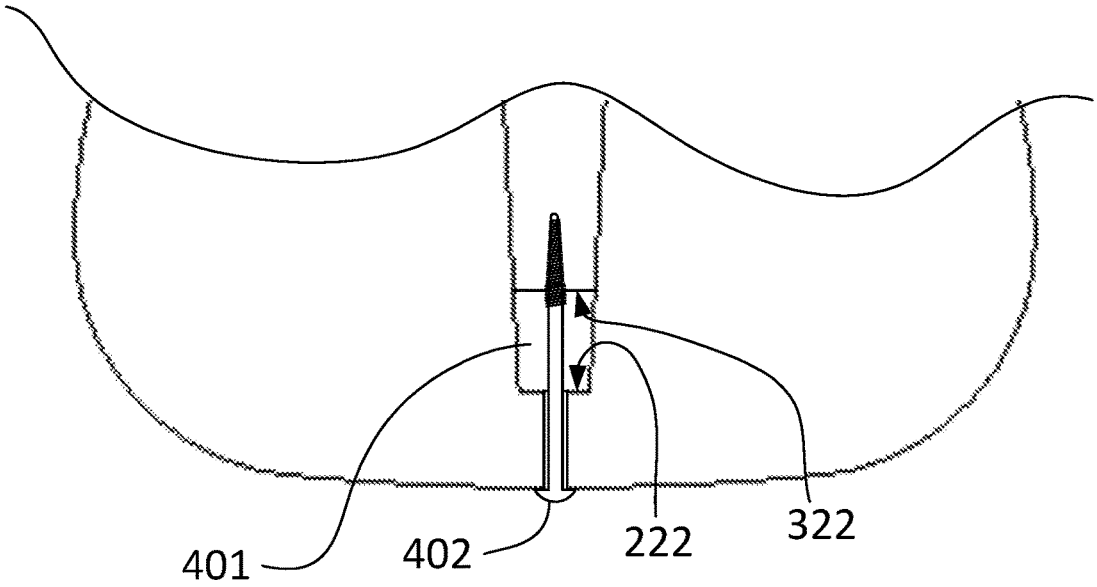
FIGS. 4A-C show views of a tensioning device according to embodiments of the present technology.
Figure 4B:
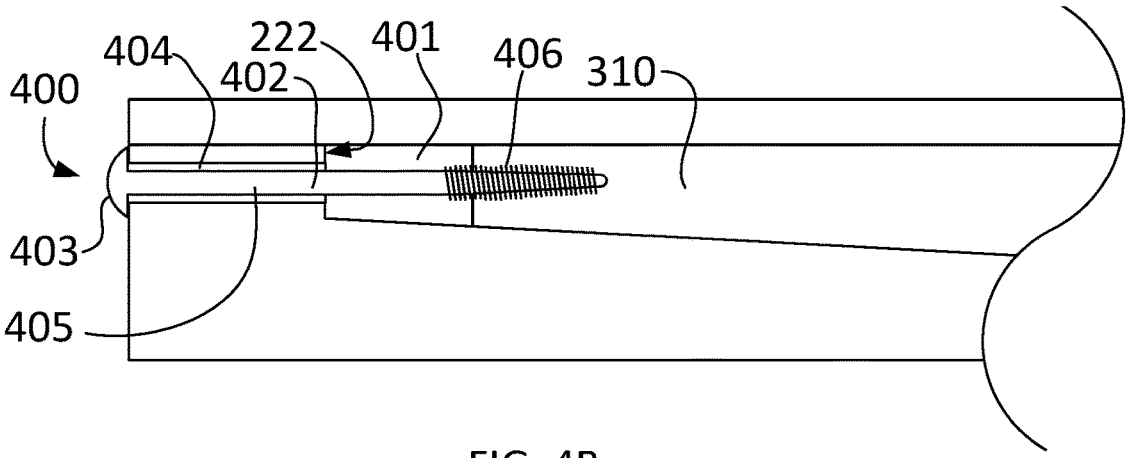
Figure 4C:
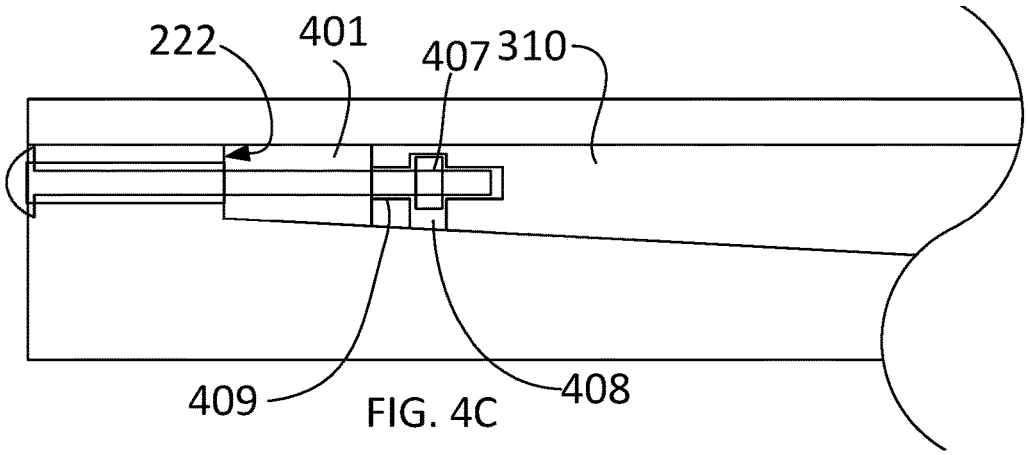

In embodiments, the mortise 210 is longer than the tenon 310 so that a void 401 is defined within the body between the tail end surface 322 of the tenon 310 and the tail end surface 222 of the mortise 210. This void may house a portion of the tensioning device 400, for example as shown in FIGS. 4A-4C. In embodiments, this void may be between 10 mm and 100 mm long along the longitudinal axis.

Tensioning Device

As noted, in embodiments, the guitar includes a tensioning device 400 that biases the tenon 310 into the mortise 210 toward the tail end 204 of the body 200 in order to fully restrain the neck assembly relative to the body in the $6^{th}$ degree of freedom. In embodiments, the tensioning device 400 may only restrain the joint in the one degree of freedom (longitudinal translation) while the interfaces of the surfaces of the mortise and tenon provide the restraint of the other 5 degrees of freedom.

In embodiments, for example as shown in FIGS. 4A and 4B the tensioning device 400 comprises a screw 402 extending in a direction parallel to the longitudinal axis 110 through the tail end 204 of the body into the void 401. The screw 402 may comprise a head 403 larger than the hole 404 extending through the body, an unthreaded shank portion 405 positioned within the hole 404 of the body in order for the screw not to thread into the body, and a threaded portion 406 is threaded through the tail end surface 322 of the tenon 310 and into the wood of the tenon as shown in FIG. 4B or into a threaded body 407 in the tenon as shown in FIG. 4C. For example, a nut may be the body 407 and may be held captive in a cavity 408 in the tenon 310 as shown in FIG. 4C. The head of the screw prevents the screw from pulling through the hole in the tail end of the body and allows the screw to be rotated to cause tension in order to pull the tenon into the mortise. When the strings are not attached to the guitar assembly, the single screw of the tensioning device pulling in a direction parallel to the longitudinal axis is the only screw, or mechanical fastener, preventing the neck assembly from being pulled out of the body.

Due to the surface of the mortise and the surface of the tenon being complementary the neck and body are self-aligning by tensioning the joint. In embodiments the tension created by the tensioning device is minimal to ensure both a constant and rigid wood to wood contact of the mortise and tenon surfaces without compressing the wood to the point of permanent deformation.

In embodiments including a captive threaded body, for example as shown in FIG. 4C, the tenon 310 may include a cavity 408 at the tail end of the tenon. The tenon may further include a through hole 409 extending from the tenon tail end surface 322 to the cavity 408. The threaded body, for example a nut or threaded plate, is positioned within the cavity and a bolt may extend through the hole in the body, through the hole in the end surface of the tenon, and thread into the threaded body. The threaded body is larger than the through hole in the tenon so that tightening the screw into the threaded body causes the tenon to be pulled in tension tighter against the mortise surfaces.

In embodiments, the tension device preventing the tenon from being pulled out of the mortise may comprise a spring or elastic band coupled between the tail end of the tenon and the tail end of the mortise. In embodiments, the tenon may be prevented from being pulled out of the mortise with a mechanical fastener extending perpendicular to the longitudinal axis, for example a screw, wherein the screw may be secured through the body into the tenon and may further be used to secure a piece of hardware, as noted above to the body. For example, the fasteners securing the bridge to the body may also extend through the body and the tenon.

Method of Assembly

In embodiments, the neck assembly may be coupled to the body by inserting the tenon 310 into the mortise 210 of the body so that the complementary surfaces directly contact each other to form a wood on wood interface. After the surfaces of the tenon are directly contacting the surface of the mortise, the screw of the tensioning device 400 may be turned to apply a pulling force in a direction parallel to the longitudinal axis in order to secure the tenon into the mortise.

Figure 5A:
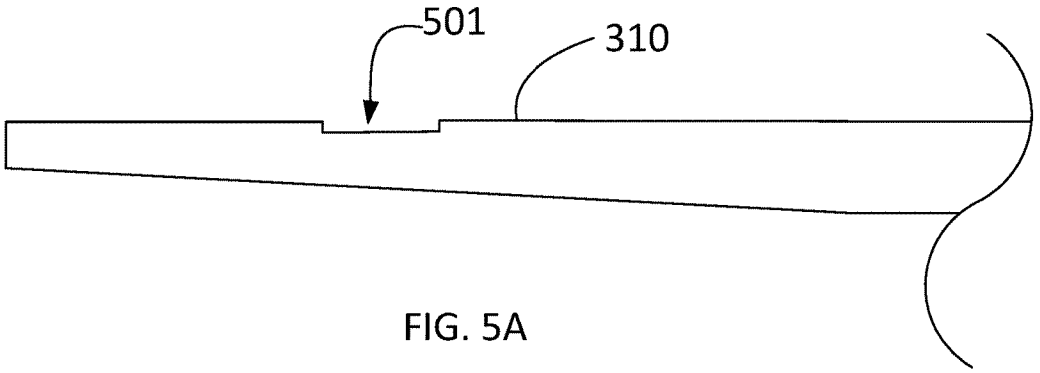
FIGS. 5A-C show views of a pickup notch of the tenon according to embodiments of the present technology.
Figure 5B:
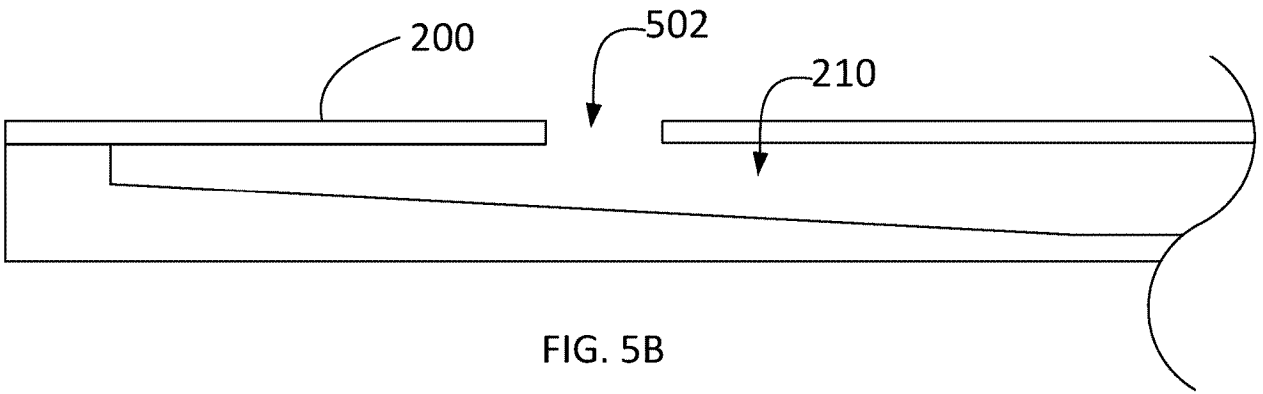
Figure 5C:
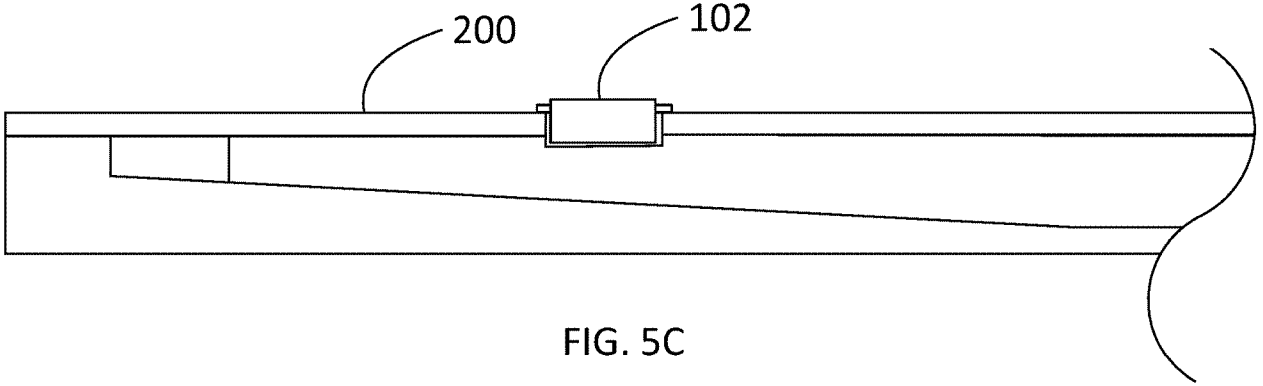

Prior to or after coupling of the neck assembly to the body, cutouts in the body and/or tenon may be formed for hardware such as electric pickups, and parts of a bridge assembly. For example, once assembled the assembly of the body and tenon may be routed to form cavities for the pickups. In embodiments, cavities for a pickup may be formed separately in the tenon and the body. For example as shown in FIG. 5A, a notch 501 is routed out of the top surface of the tenon 310 to accommodate a pickup, and a corresponding cutout 502 is routed out of the top surface of the body as shown in FIG. 5B. The notched tenon is placed within the mortise and a pickup is positioned within the cutout in the body and the notch in the tenon as shown in FIG. 5C.

The various aspects, embodiments, implementations or features of the described embodiments can be used separately or in any combination. In particular, it should be appreciated that the various elements of concepts from FIGS. 1A-5C may be combined without departing from the spirit or scope of the invention.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, or gradients thereof, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained.

Preferred embodiments of this invention are described herein, including the best mode known to the inventors for carrying out the invention. The invention is susceptible to various modifications and alternative constructions, and certain shown exemplary embodiments thereof are shown in the drawings and have been described above in detail. Variations of those preferred embodiments, within the spirit of the present invention, may become apparent to those of ordinary skill in the art upon reading the foregoing description. The inventors expect skilled artisans to employ such variations as appropriate, and the inventors intend for the invention to be practiced otherwise than as specifically described herein. Accordingly, it should be understood that there is no intention to limit the invention to the specific form or forms disclosed, but on the contrary, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context. The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of specific embodiments are presented for purposes of illustration and description. They are not intended to be exhaustive or to limit the described embodiments to the precise forms disclosed. It will be apparent to one of ordinary skill in the art that many modifications and variations are possible in view of the above teachings.

The invention claimed is:

1. A guitar comprising:

a neck defining a longitudinal axis, wherein the neck comprises a central neck portion extending in a direction parallel to the longitudinal axis and a tenon extending in a direction parallel to the longitudinal axis, wherein the central neck portion and the tenon interface at a neck heel, wherein the tenon is tapered so that a cross-section of the tenon is larger at the interface at the neck heel than at a position more distal from the neck heel;

a body defining a neck end and a tail end opposite the neck end, wherein the body further defines a mortise extending from the neck end toward the tail end, wherein the mortise comprises a mortise opening at the neck end of the body, wherein the mortise is tapered so that a cross-section of the mortise is larger at the neck end of the body than at a position closer to the tail end of the body, and wherein the tenon of the neck is complementary in shape to the mortise and is positioned within the mortise of the body; and a tensioning device extending through the tail end of the body and coupled to the tenon, wherein the tensioning device is configured to prevent the tenon from translating in a direction parallel to the longitudinal axis out of the mortise.

2. The guitar of claim 1, wherein the tenon defines four surfaces around the longitudinal axis comprising a top tenon surface, a bottom tenon surface, and two side tenon surfaces, wherein the mortise defines four surfaces around the longitudinal axis comprising a top mortise surface, a bottom mortise surface, and two side mortise surfaces, and wherein the four surfaces of the mortise surround the four surfaces of the tenon so that the top mortise surface contacts the top tenon surface, the bottom mortise surface contacts the bottom tenon surface, and each of the two side mortise surface contact one of the two side tenon surfaces.

3. The guitar of claim 2, wherein the top tenon surface is parallel to the longitudinal axis, and wherein each of the bottom tenon surface and the two side tenon surfaces are not parallel to the longitudinal axis.

4. The guitar of claim 2, wherein the two side tenon surfaces are each angled relative to the longitudinal axis at angles between 0.5 degrees and 5 degrees.

5. The guitar of claim 2, wherein the top tenon surface, and the two side tenon surfaces are each angled relative to the longitudinal axis at angles between 0.5 degrees and 5 degrees, and wherein each of the top tenon surface, and the two side tenon surfaces are angled at the same relative angle.

6. The guitar of claim 2, wherein the body is comprised of a top sheet and a bottom body portion, wherein the bottom body portion defines a mortise trench defining the bottom mortise surface and the two side mortise surfaces, and wherein a bottom surface of the top sheet is coupled to the top surface of the bottom body portion so that a portion of the bottom surface of the top sheet defines the top mortise surface.

7. The guitar of claim 2, wherein no adhesives are present between the four surfaces of the tenon and the four surfaces of the mortise.

8. The guitar of claim 1, wherein the mortise is longer than the tenon so that a cavity is present within the body between a tail end surface of the tenon and a tail end surface of the mortise, and wherein a portion of the tensioning device is within the cavity.

9. The guitar of claim 8, wherein the tensioning device consists of a single screw extending through the tail end of the body, through the cavity and threaded into the tail end surface of the tenon.

10. The guitar of claim 9, wherein no mechanical fastener other than the screw of the tensioning device extends through both the body and the neck.

11. The guitar of claim 8, wherein the tensioning device comprises a nut positioned in a second cavity defined by the tenon, and a bolt extending through the tail end of the body, through the cavity, through the tail end surface of the tenon, and threaded into the nut.

12. The guitar of claim 1, wherein a scale length is defined between a nut of the neck and a bridge coupled to the body, wherein the tenon extends into the mortise in the body to a position between the bridge and the tail end of the body.

13. The guitar of claim 1, further comprising an electric pickup coupled to the body, wherein the tenon extends into the mortise in the body to a position between the electric pickup and the tail end of the body.

14. The guitar of claim 13, wherein the tenon defines a notch, and wherein the electric pickup is positioned within the notch.

15. The guitar of claim 1, wherein the body is formed from a single piece of wood.

16. The guitar of claim 1, wherein the body is formed from two pieces of wood, and wherein surfaces of the mortise are defined by both of the two pieces of wood.

17. A method of assembling the guitar of claim 1, the method comprising:

inserting the tenon of the neck into the complementary in shape mortise of the body; and coupling the tensioning device extending through the tail end of the body to the tenon.

18. The method of claim 17, wherein the tenon defines four surfaces around the longitudinal axis comprising a top tenon surface, a bottom tenon surface, and two side tenon surfaces, wherein the mortise defines four surfaces around the longitudinal axis comprising a top mortise surface, a bottom mortise surface, and two side mortise surfaces, and wherein inserting the tenon into the mortise comprises contacting the four surfaces of the mortise to the four surfaces of the tenon so that the top mortise surface contacts the top tenon surface, the bottom mortise surface contacts the bottom tenon surface, and each of the two side mortise surface contact one of the two side tenon surfaces.

19. The method of claim 17, wherein the method does not comprise applying adhesives to interfacing surfaces between the mortise and tenon.

20. The method of claim 17, wherein after the tenon is inserted into the mortise an electric pickup is positioned within a notch defined by the tenon and then coupled to the body.

* * * * *